US010290439B2

(12) United States Patent
Dauer et al.

(10) Patent No.: US 10,290,439 B2
(45) Date of Patent: May 14, 2019

(54) PERMANENT MAGNET ASSEMBLY FOR AN ARC DRIVER ASSEMBLY AND SWITCHING DEVICE

(71) Applicants: Klaus Dauer, Koblenz (DE); Anke Juelich, Niederkassel (DE)

(72) Inventors: Klaus Dauer, Koblenz (DE); Anke Juelich, Niederkassel (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 777 days.

(21) Appl. No.: 14/360,945

(22) PCT Filed: Nov. 28, 2012

(86) PCT No.: PCT/EP2012/073797
§ 371 (c)(1),
(2) Date: May 28, 2014

(87) PCT Pub. No.: WO2013/079511
PCT Pub. Date: Jun. 6, 2013

(65) Prior Publication Data

US 2015/0048911 A1 Feb. 19, 2015

(30) Foreign Application Priority Data

Nov. 29, 2011 (EP) ..... 11191220

(51) Int. Cl.

| | |
|---|---|
| ***H01H 9/00*** | (2006.01) |
| ***H01H 9/32*** | (2006.01) |
| ***H01H 9/44*** | (2006.01) |
| ***H01F 7/02*** | (2006.01) |
| ***H01H 1/64*** | (2006.01) |

(52) U.S. Cl.
CPC ..... *H01H 9/32* (2013.01); *H01F 7/0205* (2013.01); *H01H 1/64* (2013.01); *H01H 9/443* (2013.01)

(58) Field of Classification Search
CPC ..... H01H 77/00; H01H 83/00; H01H 1/20; H01H 33/20; H01H 9/341; H01H 77/10; H01H 7/00
USPC ..... 335/207
See application file for complete search history.

(56) References Cited

U.S. PATENT DOCUMENTS

| | | | | |
|---|---|---|---|---|
| 3,815,059 | A * | 6/1974 | Spoelman | 335/16 |
| 4,367,448 | A * | 1/1983 | Nishizako | 335/201 |
| 4,451,718 | A * | 5/1984 | Yamagata et al. | 218/23 |
| 5,109,146 | A * | 4/1992 | Maenishi | 218/26 |
| 5,763,847 | A * | 6/1998 | Moldovan et al. | 218/38 |
| 6,373,016 | B2 * | 4/2002 | Brouillat et al. | 218/154 |
| 6,456,176 | B1 * | 9/2002 | Fujihira et al. | 335/6 |
| 7,551,050 | B2 * | 6/2009 | Annis et al. | 335/201 |

(Continued)

FOREIGN PATENT DOCUMENTS

| | | | |
|---|---|---|---|
| DE | 10132858 | A1 | 2/2002 |
| EP | 0473014 | A2 | 4/1992 |

(Continued)

*Primary Examiner* — Shawki S Ismail
*Assistant Examiner* — Lisa N Homza
(74) *Attorney, Agent, or Firm* — Leydig, Voit & Mayer, LTD.

(57) ABSTRACT

A permanent magnet assembly for an arc driver assembly of an electric switching device, having a permanent magnet and a cover made of electrically insulating material, wherein the cover is connected directly to the permanent magnet.

9 Claims, 3 Drawing Sheets

(56) References Cited

U.S. PATENT DOCUMENTS

| | | | | |
|---|---|---|---|---|
| 7,902,948 | B2 * | 3/2011 | Luders | 335/201 |
| 7,915,985 | B2 | 3/2011 | Schmitz et al. | |
| 8,222,983 | B2 * | 7/2012 | Zhou et al. | 335/201 |
| 8,921,728 | B2 * | 12/2014 | Lang et al. | 218/22 |
| 2008/0073327 | A1 * | 3/2008 | Annis et al. | 218/36 |
| 2009/0127229 | A1 * | 5/2009 | Schmitz et al. | 218/22 |
| 2013/0075367 | A1 * | 3/2013 | Eriksson et al. | 218/34 |
| 2013/0105444 | A1 * | 5/2013 | Prohaska et al. | 218/26 |
| 2013/0228551 | A1 * | 9/2013 | Asokan et al. | 218/23 |
| 2013/0284702 | A1 * | 10/2013 | Hamada et al. | 218/26 |
| 2014/0061160 | A1 * | 3/2014 | Juds et al. | 218/26 |
| 2014/0151338 | A1 * | 6/2014 | Gerving et al. | 218/26 |
| 2014/0175056 | A1 * | 6/2014 | Gerving et al. | 218/23 |

FOREIGN PATENT DOCUMENTS

| | | | |
|---|---|---|---|
| EP | 2061053 | A2 | 5/2009 |
| EP | 2372735 | A1 | 10/2011 |
| EP | 002393094 | A1 * | 12/2011 |
| EP | 002463880 | A1 * | 6/2012 |
| JP | 2008226547 | A | 9/2008 |

* cited by examiner

PERMANENT MAGNET ASSEMBLY FOR AN ARC DRIVER ASSEMBLY AND SWITCHING DEVICE

CROSS-REFERENCE TO RELATED APPLICATIONS

This application is a U.S. National Stage Application under 35 U.S.C. § 371 of International Application No. PCT/EP2012/073797 filed on Nov. 28, 2012, and claims benefit to European Patent Application No. EP 11191220.0 filed on Nov. 29, 2011. The International Application was published in German on Jun. 6, 2013, as WO 2013/079511 A1 under PCT Article 21(2).

FIELD

The invention relates to the permanent magnet arrangement for an arc driver arrangement for an electrical switching device with a permanent magnet and a housing made of electrical insulating material.

BACKGROUND

Permanent magnet arrangements and switching devices of the type mentioned at the beginning are known from EP 2 061 053 A2. To create a switching device for direct current applications, it is recommended that the casing of a switching device for alternating current applications should be used, wherein additional permanent magnets are provided, which create a magnetic field with field lines predominantly transverse to an isolation gap in the current paths. There are three receiving regions in the housing for each single current path, wherein each current path is assigned a movable switching contact element as well as two fixed switching contact elements opposite to each other. The three moveable switching contact elements can be moved together, between a closed position which corresponds to the switched-on status of the switching device, and an open position which corresponds to the switched-off status of the switching device. The individual current paths are each assigned two arc extinguishing devices in the form of extinguishing plates, arranged individually over one another and electrically insulated from each other. In addition, each current path has two isolation gaps which are formed between the ends of the movable switching elements and the first and second fixed switching elements which are allotted to the ends of the movable switching contact elements when the movable switching contact elements are open. On opening the switching contact elements, an arc which can be extinguished with the help of one of the arc extinguishing devices is formed along each isolation gap. Since arcs in direct current applications cannot be extinguished during zero current passing as in alternating current applications, a magnetic field that drives the arc into an arc extinguishing device has to be used in direct current applications. This magnetic field is built up by the arrangement of two permanent magnets for each current field, wherein a magnetic field is built up with field lines in a direction that runs transverse to the isolation gaps and creates a Lorenz force on the arcs that form along these isolation gaps which drives the arcs in the direction of the arc extinguishing devices. The arc extinguishing devices each comprise two permanent magnet arrangements. Each of these comprises one permanent magnet and a recording chamber in the casing of the switching device. The recording chambers are assigned to the isolation gaps and assigned to both sides of these isolation gaps, so that they record the isolation gaps between them. The permanent magnets are put in and recorded in the recording chambers. Thus the permanent magnets are almost completely enclosed by the walls of the recording chamber and electrically insulated by these. Only one part of the permanent magnet protrudes beyond an opening in the recording chamber. Under high voltage there is the danger that an arc could flash onto the permanent magnets.

SUMMARY

An aspect of the invention provides a permanent magnet arrangement, comprising: a permanent magnet, wherein the permanent magnet arrangement is configured for an arc driver arrangement for an electrical switching device including the permanent magnet and a housing, wherein the housing includes electrical insulation material, wherein the housing is connected directly to the permanent magnet.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
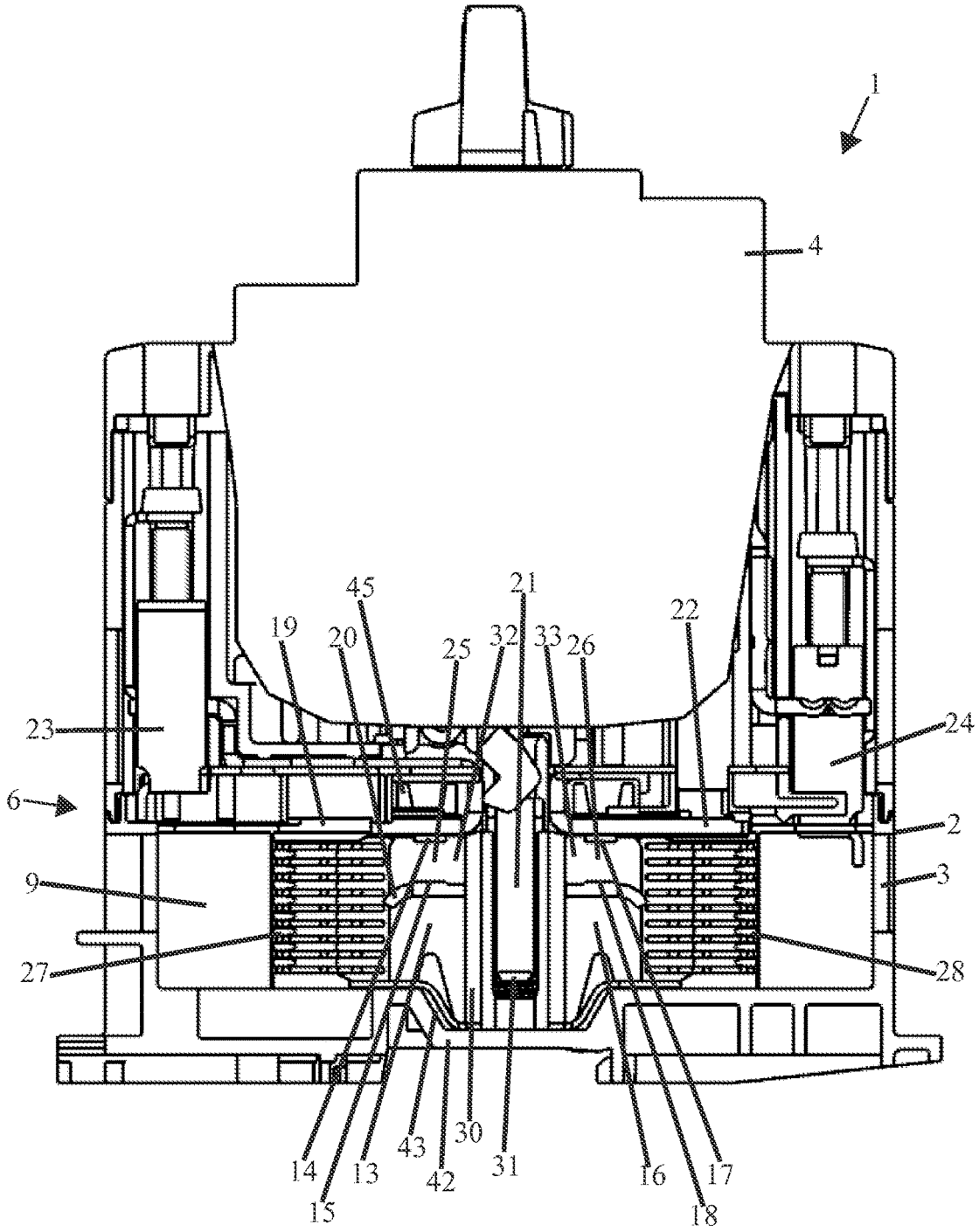
FIG. 1 shows a longitudinal section of a switching device according to the invention.

An aspect of the invention provides a permanent magnet arrangement for an arc driver arrangement for an electrical switching device with a permanent magnet and a housing made of electrical insulating material. A further aspect of the invention provides a switching device for direct current application with at least one current path, at least one switching contact arrangement to interrupt the path of the current, wherein the switching contact arrangement is arranged in a switching chamber in the casing of the switching device with an arc driver arrangement which is arranged in the switching chamber and produces a magnetic field at least in the area of the switching contact arrangement for each current path.

An aspect of the invention provides a permanent magnet arrangement that would prevent as far as possible any flashing of an arc onto the permanent magnets and thereby prevent the combustion of the permanent magnet.

An aspect of the invention provides a permanent magnet arrangement for an arc driver arrangement for an electrical switching device, wherein the permanent magnet arrangement comprises a permanent magnet and a housing made of electrical insulating material, wherein the housing is connected directly to the permanent magnet.

Thus it is possible to directly provide that part of the permanent magnet that protrudes from the recording chamber (which may also be referred to as a receiving chamber)

for the permanent magnet with a housing, so that the flashing of the arc on this protruding part of the permanent magnet is prevented. Thus the permanent magnet is completely electrically insulated in the position taken in the recording chamber. It is also advantageous here that the permanent magnet can be provided with the housing before being inserted into the recording chamber and can be made available as a prefabricated unit. The housing can be detachable or non-detachable, e.g. bonded to the permanent magnet.

Another aspect of the invention provides a switching device for direct current applications that comprises at least one current path, at least one switching contact arrangement to interrupt a current path, wherein the switching contact arrangement in the switching chamber is arranged in a cover for the switching device, as well as an arc driver arrangement that is arranged in the switching chamber and produces a magnetic field at least in the area of the switching contact arrangement for each current path, whereby the arc driver arrangement comprises at least one permanent magnet arrangement as described above.

The arc driver arrangement can be structured in different ways. For example, it can be provided that two permanent magnet arrangements as described above are provided between which the switching contact arrangement is arranged. However, it is also conceivable that only one permanent magnet arrangement is provided, which is linked to two parallel pole plates, wherein the permanent magnet is arranged above the switching contact arrangement and the pole plates absorb the switching contact arrangement between them.

In the embodiment the permanent magnet arrangement can be incorporated in a recording chamber of the casing of the switching device and exclusively protrude from the recording chamber with the housing. Thus the housing forms part of the electrical insulation. The part of the permanent magnet protruding from the recording chamber is electrically insulated by the housing, so that any flashing of an arc onto the permanent magnet is prevented.

The recording chamber can thus be incorporated into a wall of the casing.

The wall is preferably made of electrical insulation and magnetically permeable material, for example from thermoset or heat-resistant thermoplastic resin or ceramic. The housing can also be made of the same material.

The permanent magnet arrangement can have a coding projection that is provided on the permanent magnet, for example, with which the permanent magnet arrangement sinks in a coding aperture in the recording chamber. This guarantees that the permanent magnet is fundamentally inserted in the correct magnetic orientation in the recording chamber, in order to ensure that an arc is driven in the right direction, i.e. in an extinguishing direction. For the eventuality that the permanent magnet and the permanent magnet arrangement are inserted in the wrong direction in the recording chamber, the recording chamber has been structured in such a way that the coding projection cannot sink into the coding aperture and that the permanent magnet arrangement projects further out of the recording chamber than it does when it is correctly inserted. Thus a direct visual examination of the correct positioning of the permanent magnet arrangement is possible. In addition it can be provided, for example, that a lid or other components of the switching device cannot be fitted if the permanent magnet arrangement is incorrectly inserted, insofar as the other components hit against the permanent magnet arrangement and prevent the assembly of the other components.

Figure 2:
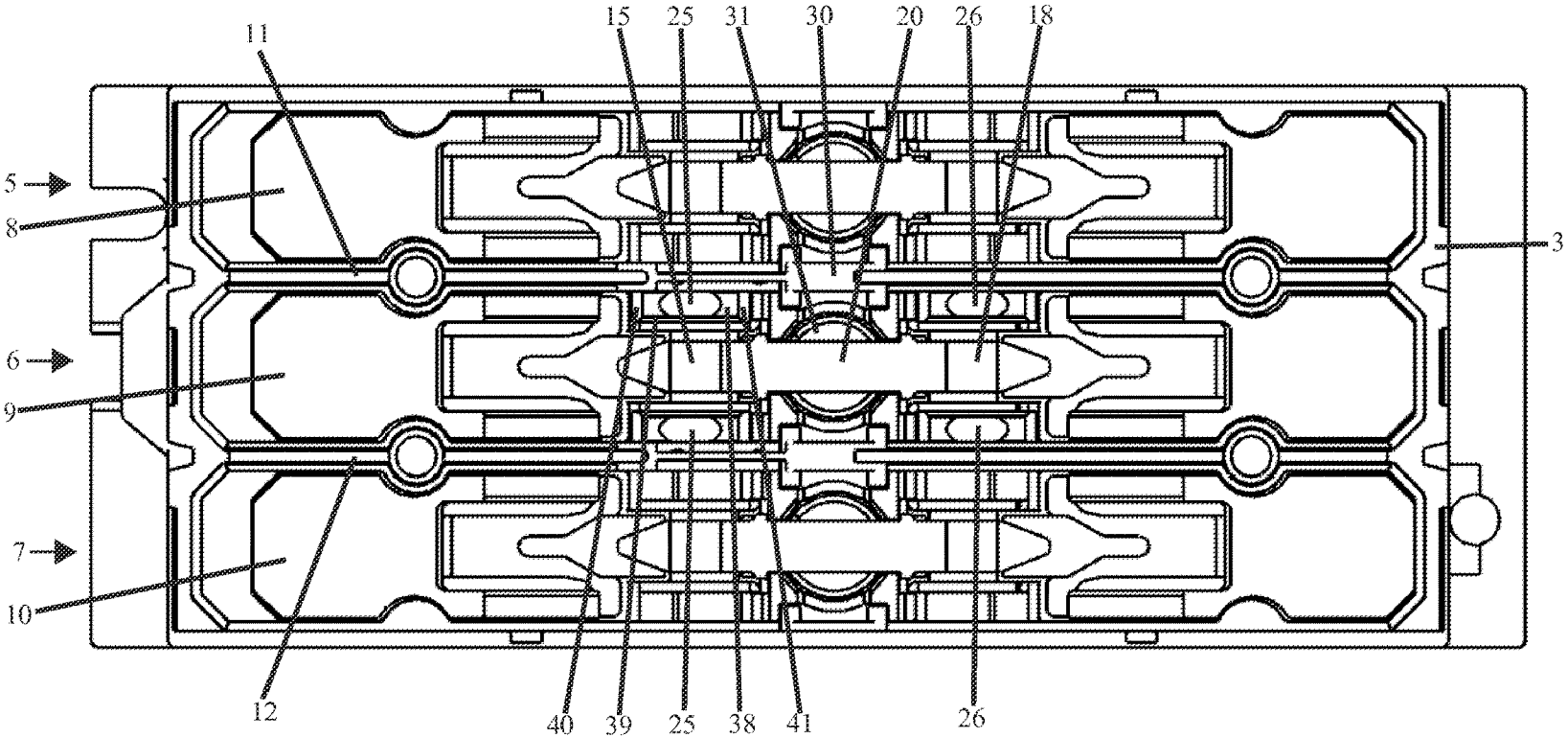
FIG. 2 shows a top view of the switching device according to FIG. 1.

FIG. 1 shows the switching device 1 according to the invention in a partial longitudinal section with a casing 2, which comprises a lower part 3 and an upper part 4. FIG. 2 shows a view of switching device 1, whereby the upper part 4 has been removed so that it is possible to look into the lower part 3. FIGS. 1 and 2 are presented jointly below.

Switching device 1 presents three poles, i.e. three switching paths, namely a first switching path 5, a second switching path 6 and a third switching path 7. Each switching path 5, 6, 7 is arranged in a separate switching chamber, namely a first switching chamber 8, a second switching chamber 9 and a third switching chamber 10. The switching chambers 8, 9, are separated from each other electrically by partitions 11, 12 in the casing 2, wherein the partitions 11, 12 are preferably magnetically permeable. The three current paths 5, 6, 7 are identical with regard to their construction, wherein the construction of the current paths 5, 6, 7 are described in more detail in the following taking the middle, second current path 6 as an example.

The second current path 6 within the second switching chamber 9 is illustrated in longitudinal section in FIG. 1. The second current path 6 is double break constructed and shows a first switching contact arrangement 13 and a second switching contact arrangement 16. Both switching contact arrangements 13, 16 are identical and formed as mirror images of each other.

The first switching contact arrangement 13 which is illustrated in FIG. 1 on the left side, comprises a contact pair with a first contact 14 and a second contact 15. Correspondingly the second switching contact arrangement 16 is constructed with a second contact pair comprising a first contact 17 and a second contact 18.

The first contact 14 in the first switching contact arrangement 13 is arranged on a first fixed contact carrier 19. The first fixed contact carrier 19 is stationary and is therefore assigned as immobile in casing 2 of switching device 1. The first contact 14 is arranged at one first free end of the first fixed contact carrier 19. At one end not facing this end of the first fixed contact carrier 19 a first connection 23 for the connection of the first current path 5 in a direct current application is provided.

The second contact 15 of the first switching contact arrangement 13 is found on a bridge contact piece 20 of a bridge arrangement 21 and is arranged as moveable in casing 2. The bridge contact piece 20 can be vertically adjusted in the orientation illustrated in FIG. 1 to a raised or lowered position. In the raised position the second contact 15 in the first switching contact arrangement 13 comes into contact with the first contact 14. In the lowered position both the contacts 14, 15 are not in contact. In this position an isolation gap is created between the first contact 14 and the second contact 15, along which it is possible for an arc to form.

The second switching contact arrangement 16 is constructed identically to the first switching contact arrangement 13. The first contact 17 in the second switching contact arrangement 16 is positioned on a second fixed contact carrier 22 and is arranged on a first end of the second fixed contact carrier 22. At one end not facing this end of the second fixed contact carrier 22 a second connection 24 is provided.

The second contact 18 of the second switching contact arrangement 16 is also arranged on the bridge contact piece 20 and at one end of the second contact 15 of the first switching contact arrangement 13 not facing the latter. The bridge contact piece 20 is constructed to conduct electricity and connects both the contacts 15, 18 electrically to each other. In the raised position of the bridge contact piece 20 the second contact 18 of the second switching arrangement 16 is in contact with the first contact 17, wherein in the lowered position of the bridge contact piece 20 both contacts 17, 18 are kept out of contact and between these an isolation gap is created along which it is possible for an arc to form.

In the raised position of the bridge contact piece 20 a current can therefore flow from the first connection 23 via the first fixed contact carrier 19 to the first contact of the first switching contact arrangement 13, then further to the second contact 15 of the first switching contact arrangement 13 via the bridge contact piece 20 to the second contact 18 of the second switching contact arrangement 16. From there the current flows further to the first contact 17 of the second switching contact arrangement 16 via the second fixed contact carrier 22 to the second connection 24.

In order to adjust the bridge contact piece 20 a switch bridge 30 is provided, which is arranged vertically adjustable in casing 2 and moves the bridge contact piece 20. In the raised position of the bridge contact piece 20, which corresponds to the switched-on status of the switching device 1, the bridge contact piece 20 with its two contacts 15, 18 is pressed via a spring 31 against the first contacts 14, 17, wherein the spring 31 is supported between the bridge contact piece 20 and the switch bridge 30.

In the second switching chamber 9 two extinguishing devices, namely a first extinguishing device 27 and a second extinguishing device 28 are provided. The first extinguishing device 27 is assigned to the first switching contact arrangement 13 and the second extinguishing device 28 is assigned to the second switching contact arrangement 16. Both extinguishing devices 27, 28 are arranged on one of the opposite sides of the switch bridge arrangement 21 for the relevant switching contact arrangement 13, 16.

In order to drive arcs that are created between the contact pairs in the extinguishing devices 27, 28, two arc driver arrangements are provided in the second switching chamber 9, namely a first arc driver arrangement 32 and a second arc driver arrangement 33, wherein the first arc driver arrangement 32 is assigned to the first switching contact arrangement 13 and the second arc driver arrangement 33 is assigned to the second switching contact arrangement 16. The first arc driver arrangement 32 comprises two first permanent magnet arrangements 25, which are arranged in the second switching chamber 9 and which take up the first switching contact arrangement 13 between themselves. The first permanent magnet arrangements 25 are arranged parallel to the partitions 11, 12. Both first permanent magnets 25 are arranged with rectified magnetism so that an almost homogeneous magnetic field with field lines diagonally towards the separation direction is created between them. Thus the field lines of the magnetic field also run diagonally to an arc that is created between the first contact 14 and the second contact 15 in the first switching contact arrangement 13. A Lorenz force is thereby created by the magnetic field which influences the arcs and drives them in the direction of the first extinguishing device 27.

The second arc driver arrangement 33 is constructed in the same way as the first arc driver arrangement 32 and comprises two permanent magnet arrangements 26, which take up the second switching contact arrangement 16 between them. The magnetic field can be aligned in the same direction as that in the first permanent magnet arrangement 25. An arc that forms between the first contact 17 and the second contact 18 in the second switching contact arrangement 16, has a current direction that is spatially the opposite direction to an arc between the contacts 14, 15 of the first switching contact arrangement 13. If an arc according to the illustration in FIG. 1 between the contacts 17, 18 in the second switching contact arrangement 16 has a current direction that flows vertically downwards, an arc between the contacts 14, 15 in the first switching contact arrangement shows a current direction that flows vertically upwards. In order to drive an arc in the first contact arrangement 13 to the left and an arc in the second contact arrangement 16 to the right in the second extinguishing device 28, the magnetic fields must be oriented in the same direction. In the case of such an orientation, switching device 1 is only suitable for one current direction, because in another current direction it is not able to drive the arcs in the extinguishing devices. In order to achieve independence from the direction of the current, the magnetic fields for both of the arc driver arrangements 32, 33 can be arranged as opposite to each other, so that in the first current direction the arc in the first switching contact arrangement 13 and in the second direction of the current opposed to the first the arc in the second switching contact arrangement 16 is extinguished.

The first current path 5 and the third current path 7 and the first switching chamber 8 and the third switching chamber 10 are identical to the second current path 6 and the second switching chamber 9, with the exception that in the first switching chamber 8 and the third switching chamber 10 no arc driver arrangements are provided. Therefore in the first switching chamber 8 and the third switching chamber 10 no permanent magnet arrangements are provided. The arc driver arrangements 32, 33 in the first current path 6 radiate onto the neighbouring switching chambers, namely the first switching chamber 8 and the third switching chamber 10, in order to be able to exert a Lorenz force on an arc created there as well. In principle, however, the first switching chamber 8 and the third switching chamber 10 can be equipped with arc driver arrangements.

Figure 3:
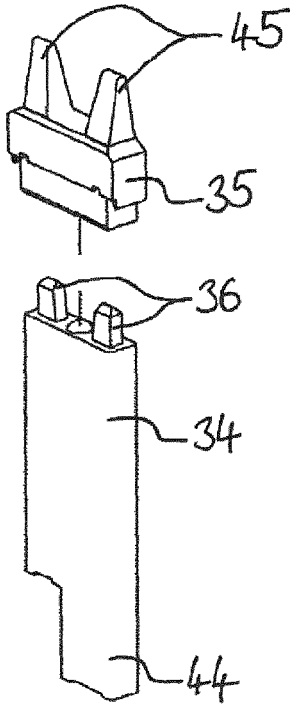
FIG. 3 shows an explosion drawing of a permanent magnet arrangement according to the invention.
Figure 4:
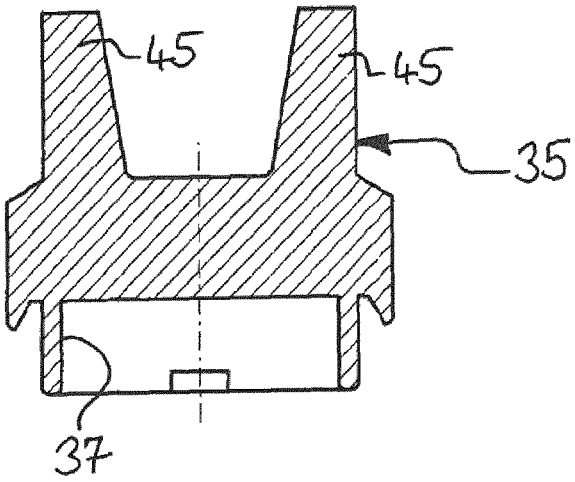
FIG. 4 shows a longitudinal section of the housing for the permanent magnet arrangement according to FIG. 3.

In FIGS. 3 and 4 the first permanent magnet arrangement 25 is illustrated in detail. The other permanent magnet arrangements are constructed identically. The first permanent magnet arrangement 25 comprises a permanent magnet 34, which is plate shaped. At one end of the permanent magnet 34, which in the illustration according to FIG. 1 is the upper end, a housing 35 made of electrical insulation material is directly fixed to the permanent magnet 34. The permanent magnet 34 presents mounting projections 36 that sink into a mounting recess 37 in the housing 35. The housing 35 can be connected to the permanent magnet 34 so that it can be detached via a connection or fixed via adhesive, for example.

From FIG. 2 it can be seen that recording chambers 38 are provided in the switching chambers 8, 9, 10. Recording chamber 38 in the second switching chamber 9 is described in detail as an example. The recording chamber 38 is arranged on one of the partitions 11, wherein the partition 11 also forms a wall of the recording chamber 38. In addition the recording chamber 38 comprises an inner wall 39 that runs parallel to the partition 11 as well as side walls 40, 41 that connect the partition 11 and the inner wall 39, so as to create a recording chamber 38 which is open at the top as in FIG. 1. This is closed at the bottom by a bottom wall 42 of the housing 2. The permanent magnet 34 with the fixed housing 35 is pushed into the recording chamber 38 from above, wherein only the housing 35 protrudes from the recording chamber 38. Since all the walls 12, 39, 40, 41 of the recording chamber 38 are made of electrical insulation material, the flashing of an arc onto the permanent magnet 34 is effectively prevented.

On an opposite side of the housing 35 the permanent magnet 34 has a coding projection 44, with which it sinks into a coding aperture 43 in the recording chamber 38. Since the coding projection 44 and the coding aperture 43 are arranged lightly to one side of a symmetry axis, the permanent magnet 34 can only be inserted according to one of its magnetic directions. This prevents a false magnetic field from being created.

In addition, the housing 35 shows upward pointing stop projections 45. If the permanent magnet 34 is inserted into the recording chamber 38 the wrong way round, the coding projection 44 cannot sink into the coding aperture 43, so that the permanent magnet 34 protrudes further out of the recording chamber 38 than if it had been inserted correctly. In this incorrect position the fixed contact carrier 19 cannot be mounted as it knocks against the stop projections 45. This ensures that incorrect assembly is totally avoided.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SYMBOLS

1 Switching device
2 Casing
3 Lower part
4 Upper part
5 First current path
6 Second current path
7 Third current path
8 First switching chamber
9 Second switching chamber
10 Third switching chamber
11 Partition
12 Partition
13 First switching contact arrangement
14 First contact
15 Second contact
16 Second switching contact arrangement
17 First contact
18 Second contact
19 First fixed contact carrier
20 Bridge contact piece
21 Bridge arrangement
22 Second fixed contact carrier
23 First connection
24 Second connection
25 First permanent magnet arrangements
26 Second permanent magnet arrangements
27 First extinguishing device
28 Second extinguishing device
29 Extinguishing plates
30 Switch bridge
31 Spring
32 First arc driver arrangement
33 Second arc driver arrangement
34 Permanent magnet
35 Housing
36 Mounting projection
37 Mounting recess
38 Recording chamber
39 Inner wall
40 Side wall
41 Side wall
42 Bottom wall
43 Coding aperture
44 Coding projection
45 Stop projection

The invention claimed is:

1. A permanent magnet arrangement configured for an arc driver arrangement for an electrical switching device, the permanent magnet arrangement comprising:

a permanent magnet configured to be received by a receiving chamber of the electrical switching device, wherein a portion of the permanent magnet protrudes from the receiving chamber when received therein; and a housing directly connected to the permanent magnet and including electrical insulation material, wherein the housing is configured to enclose and electrically insulate the portion of the permanent magnet that protrudes from the receiving chamber.

2. The permanent magnet arrangement of claim 1, wherein the housing includes electrical insulation and magnetically permeable material.

3. A switching device for direct current applications, the switching device comprising:

a casing including a receiving chamber;

a switching chamber;

a current path;

a switching contact arrangement configured to interrupt the current path, the switching contact arrangement being arranged in the switching chamber, and an are driver arrangement arranged in the switching chamber, the arc driver arrangement being configured to create a magnetic field at least in the area of the switching contact arrangement for each current path, the arc driver arrangement including a permanent magnet arrangement having:

a permanent magnet configured to be received by the receiving chamber of the casing, wherein a portion of the permanent magnet protrudes from the receiving chamber when received therein, and a housing configured to enclose and electrically insulate the portion of the permanent magnet that protrudes from the receiving chamber.

4. The device of claim 3, wherein the casing includes a second receiving chamber and wherein the arc driver arrangement includes a second permanent magnet arrangements, the second permanent magnet arrangement having:

a second permanent magnet configured to be received by the second receiving chamber of the casing, wherein a portion of the second permanent magnet protrudes from the second receiving chamber when received therein, and a housing configured to enclose and electrically insulate the portion of the second permanent magnet that protrudes from the second receiving chamber, and wherein the switching contact arrangement is arranged between the two permanent magnet arrangements.

5. The device of claim 3, wherein the recording chamber is incorporated in a wall of the casing.

6. The device of claim 5, wherein the wall includes electrical insulation and magnetically permeable material.

7. The device of claim 3, wherein the permanent magnet arrangement includes a coding projection, and wherein the permanent magnet arrangement, along with the coding projection, is configured to sink into a coding aperture in the receiving chamber.

8. The device of claim 3, further comprising one or more additional switching contact arrangements, wherein the arc driver arrangement includes one or more additional permanent magnet arrangements, each additional permanent magnet arrangement comprising:

an additional permanent magnet configured to be received by an additional receiving chamber of the casing, wherein a portion of the additional permanent magnet protrudes from the additional receiving chamber when received therein, and an additional housing configured to enclose and electrically insulate the portion of the additional permanent magnet that protrudes from the additional receiving chamber wherein each switching contact arrangement is arranged between the two permanent magnet arrangements.

9. A switching device for direct current applications, the device comprising:

a casing including a receiving chamber;

a switching chamber;

a current path;

a switching contact arrangement configured to interrupt the current path, the switching contact arrangement being arranged in the switching chamber;

an arc driver arrangement arranged in the switching chamber, the arc driver arrangement being configured to create a magnetic field at least in the area of the switching contact arrangement for the current path, wherein the arc driver arrangement includes a permanent magnet arrangement, the permanent magnet arrangement comprising:

a permanent magnet configured for an arc driver arrangement for an electrical switching device including the permanent magnet, and a housing; and wherein the permanent magnet arrangement includes a coding projection, and wherein the permanent magnet arrangement, along with the coding projection, is configured to sink into a coding aperture in the receiving chamber.

* * * * *